US006663481B2

(12) United States Patent
Nauche

(10) Patent No.: US 6,663,481 B2
(45) Date of Patent: Dec. 16, 2003

(54) METHOD OF IMPROVING THE ACCURACY OF A BEVELING OPERATION APPLIED TO A SPECTACLE LENS, AND A CORRESPONDING BEVELING TOOL

(75) Inventor: Michel Nauche, Soisy-sous-Montmorency (FR)

(73) Assignee: Essilor International (Compagnie Generale d'Optique), Le Pont (FR)

( * ) Notice: Subject to any disclaimer, the term of this patent is extended or adjusted under 35 U.S.C. 154(b) by 88 days.

(21) Appl. No.: 09/901,696

(22) Filed: Jul. 11, 2001

(65) Prior Publication Data

US 2002/0021404 A1 Feb. 21, 2002

(30) Foreign Application Priority Data

Jul. 11, 2000 (FR) ..... 00 09046

(51) Int. Cl.[7] ..... B23F 21/03
(52) U.S. Cl. ..... 451/541; 451/546
(58) Field of Search ..... 451/540, 541–544, 451/546

(56) References Cited

U.S. PATENT DOCUMENTS

| | | | | |
|---|---|---|---|---|
| 1,666,746 A | | 4/1928 | Maynard | |
| 1,701,669 A | | 2/1929 | Farve | |
| 3,036,412 A | * | 5/1962 | Tocci-guilbert | |
| 3,263,377 A | * | 8/1966 | Charvat | |
| 4,549,372 A | | 10/1985 | Sexton et al. | |
| 5,031,269 A | | 7/1991 | Lautenschlager | |
| 5,495,844 A | * | 3/1996 | Kitajima et al. | 451/541 |
| 5,560,348 A | | 10/1996 | Markley et al. | |
| 6,309,292 B1 | * | 10/2001 | Montabaur et al. | 451/542 |
| 6,402,606 B1 | * | 6/2002 | Kusakabe et al. | 451/541 |

FOREIGN PATENT DOCUMENTS

DE 4334887 8/1994

* cited by examiner

*Primary Examiner*—Eileen P. Morgan
(74) *Attorney, Agent, or Firm*—Young & Thompson

(57) ABSTRACT

A beveling operation is applied to a spectacle lens to blunt the sharp edges of its contour. Compensation means having a capacity for elastic deformation are operative between an active periphery of a beveling tool and its support shaft during the beveling operation. Applications include numerically controlled grinding machines.

20 Claims, 3 Drawing Sheets

METHOD OF IMPROVING THE ACCURACY OF A BEVELING OPERATION APPLIED TO A SPECTACLE LENS, AND A CORRESPONDING BEVELING TOOL

BACKGROUND OF THE INVENTION

1. Field of the Invention

The present invention relates generally to beveling spectacle lenses.

2. Description of the Prior Art

Trimming a spectacle lens, which is necessary so that its contour conforms to the required contour, usually by grinding, forms a sharp cutting edge at the periphery of each of its front and rear faces, possibly with burrs associated with surface treatment of those faces. This is known in the art.

The edge is usually beveled in order to deburr and round it, if only for safety reasons, and so make it less sharp.

Initially carried out as a manual reworking operation, such beveling is now carried out automatically, at least on some grinding machines, and in particular on numerically controlled grinding machines.

During beveling, a particular position set point is applied between the beveling tool and the spectacle lens being worked or, to be more precise, between a shaft supporting the beveling tool and a shaft supporting the spectacle lens, which in practice usually takes the form of two half-shafts with the lens gripped between them.

However, because of inevitable random deformations of the more usual spectacle lenses, and equally inevitable software and hardware inaccuracies of the grinding machines available, for example with regard to the relative position of the support shafts and half-shafts in question, it is currently difficult, if not impossible, to carry out the required beveling reliably and with all the necessary accuracy.

On the contrary, it is by no means rare to observe unwanted spreading of the value across the flat of the bevel, i.e. the width of the bevel, all along the worked edge.

A general object of the present invention is to provide a simple and effective way to overcome this problem, and one which yields other advantages.

To be more precise, the present invention consists firstly in a method of improving the accuracy of a beveling operation applied to a spectacle lens; it further consists in a beveling tool for implementing the method.

SUMMARY OF THE INVENTION

The invention provides a method of improving the accuracy of a beveling operation applied to a spectacle lens, wherein compensation means having a capacity for elastic deformation are inserted between, on the one hand, the periphery concerned of either the beveling tool used or the worked spectacle lens and, on the other hand, a support shaft for said tool or said lens.

The invention also provides a tool for beveling spectacle lenses, the tool being of the kind including a hub adapted to enable it to be fitted to a support shaft, at least one working rim constrained to rotate with the hub, and compensation means having a capacity for elastic deformation between an active periphery of the working rim and the hub.

In the present context, the expression "compensation means" refers to means having a capacity for elastic deformation, i.e. means enabling the intervention of such a capacity for deformation.

In one particular embodiment, the compensation means are operative within the beveling tool itself, for example.

Their capacity for elastic deformation then enables the beveling tool to be deformed if the force applied to it is too high, so that the periphery of the tool assumes a position in space enabling it to be applied optimally to the spectacle lens worked, ensuring interengagement of the beveling tool and the spectacle lens and systematically absorbing any spread in terms of the position of those two members relative to each other.

This achieves the required advantageous result of regularizing the value across the flat of the bevel, which is to the benefit of the quality and the reliability of the corresponding beveling operation.

However, other things being equal, it is possible, if required, to make do with a less rigorously calibrated position of the beveling tool relative to the worked spectacle lens, with the benefit of simplifying fabrication of the corresponding grinding machine.

The compensation means used in this way within the beveling tool also advantageously reduce its inertia, which is to the benefit of the overall dynamics.

Finally, a beveling tool including this kind of compensation means can, if required, be mounted on a support shaft at the same time as another rigid beveling tool, so that the resulting grinding machine can, at will, either ensure faithful and rigorous compliance with a particular position set point or accommodate some modulation of that position set point, with the benefit of flexibility of use to suit the application.

The features and advantages of the invention will emerge from the following description, which is given by way of example and with reference to the accompanying diagrammatic drawings.

DETAILED DESCRIPTION OF THE PREFERRED EMBODIMENTS

Figure 3:
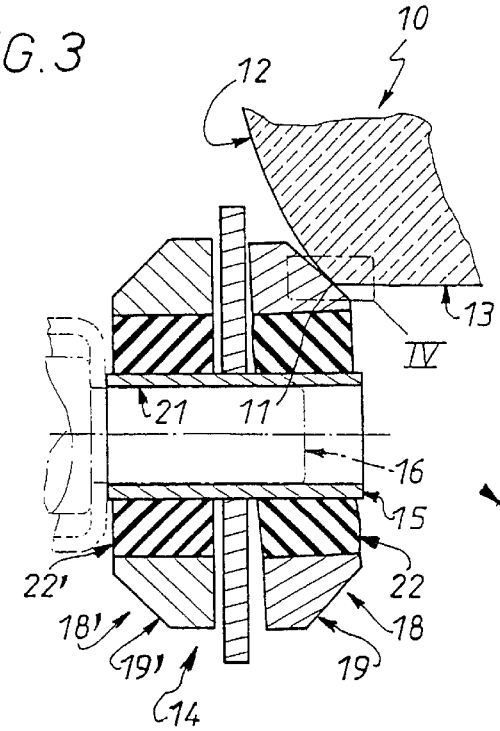
FIG. 3 is a view in axial section derived from that of FIG. 1 and showing the operation of the beveling tool according to the invention.

Referring to FIG. 3, the overall aim is to use a bevel to blunt the sharp edge along the contour of a spectacle lens 10, for example, as shown here, along front edge 11 of the spectacle lens 10, i.e. the edge where its front face 12 and its peripheral contour 13 intersect.

The beveling operation is carried out in the usual way using a beveling tool 14 including a tubular hub 15 enabling it to be fitted to a support shaft 16 shown in dashed outline in the figures and at least one working rim 18 constrained to rotate with the hub 15.

The working rim 18 has an abrasive active periphery 19. This is also known in the art.

The active periphery 19 extends along a frustoconical facet of the working rim 18, for example, as shown here.

R denotes its mean radius.

Finally, the support shaft 16 of the beveling tool 14 and the support shaft holding the spectacle lens 10 to be worked, which, in the usual way, consists in practice of two support half-shafts adapted to grip the spectacle lens 10 between them, are mounted so that they can rotate.

Because the corresponding provisions are well known in the art, and are not in themselves relevant to the present invention, they are not described in more detail here.

In accordance with the invention, compensation means, i.e. means having a capacity for elastic deformation, are inserted between the periphery concerned of the member constituted by the beveling tool 14 or the spectacle lens 10 being worked, on the one hand, and the support shaft of that member, on the other hand.

In the embodiments shown, the compensation means are operative within the beveling tool 14.

To be more precise, the beveling tool 14 includes compensation means between the active periphery 19 of its working rim 18 and its hub 15 or, to be even more precise, between the active periphery 19 of its working rim 18 and the inside periphery 21 of its hub 15.

Figure 1:
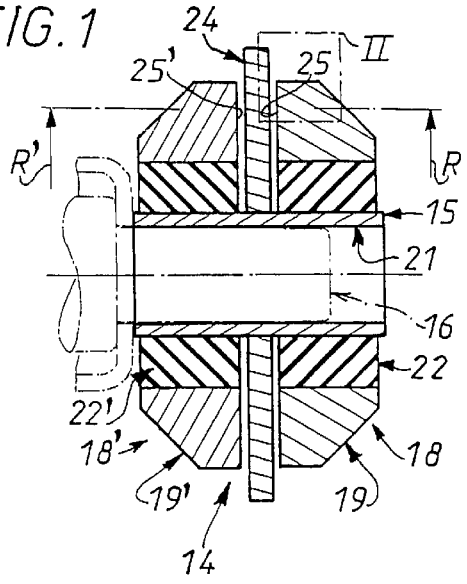
FIG. 1 is a view in axial section of a beveling tool in accordance with the invention.
Figure 2:
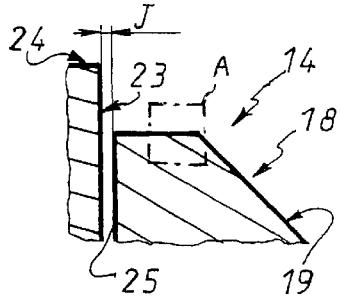
FIG. 2 shows to a larger scale the detail II from FIG. 1.
Figure 2A:
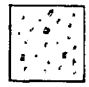
FIG. 2A shows to a larger scale the detail A from FIG. 2 in plan view.

In the embodiment shown more particularly in FIGS. 1 to 4 and especially FIG. 2A, the working rim 16 includes a rigid material binder in which are disseminated abrasive grains of diamond, silicon, boron nitride or any other abrasive material having a mean diameter from 4 to 20 microns, and the compensation means having a capacity for elastic deformation include an intermediate part 22 disposed radially between the working rim 18 and the hub 15 and made from a flexible material, for example an elastomer.

In the embodiment shown in FIGS. 1 to 4, in which the outside periphery of the hub 15 and the inside periphery of the working rim 18 are cylindrical, and in practice coaxial, they are glued together, for example.

The compensation means used in this way in accordance with the invention preferably have an elasticity corresponding to a Shore A hardness from 40 to 80 (see French standard NF T 46052), a yield stress from 4 to 10 MPa, an elongation at the yield point greater than 200% (see French standard NF T 46002), and a tearing limit greater than 4 DaN/cm$^2$ (see French standard NF T 46007C).

As a corollary of this, the cutting power of the working rim 18 along the active periphery 19 is preferably limited.

As is the case in all the embodiments shown, the working rim 18 of the beveling tool 14 is preferably associated with abutment means 23 from which it is separated by a clearance J when at rest.

As shown here, for example, the abutment means 23 include a disk 24 coaxial with, fastened to and extending transversely to the hub 15.

In practice the face 25 of the working rim 18 opposite its active periphery 19 faces toward and is parallel to the disk 24 and is therefore itself transverse to the hub 15.

In practice, the abutment means 23 are reduced to the disk 24.

In the embodiments shown in FIGS. 1 to 9, the beveling tool 14 according to the invention has two working rims 18, 18', one on each side of the disk 24.

In practice the two working rims 18, 18' are identical.

Figure 9:
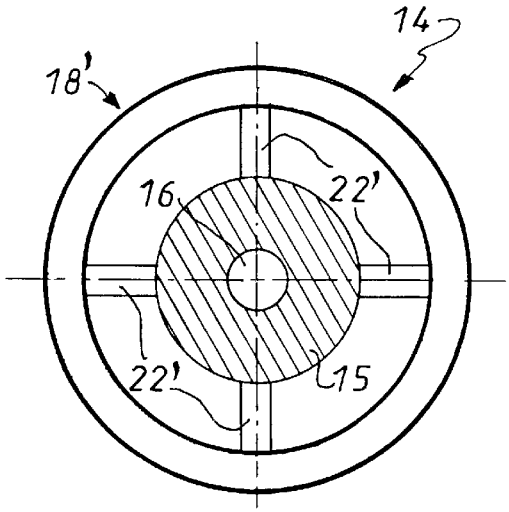
FIG. 9 is a view in elevation and in section taken along the line IX—IX in FIG. 8.
Figure 8:
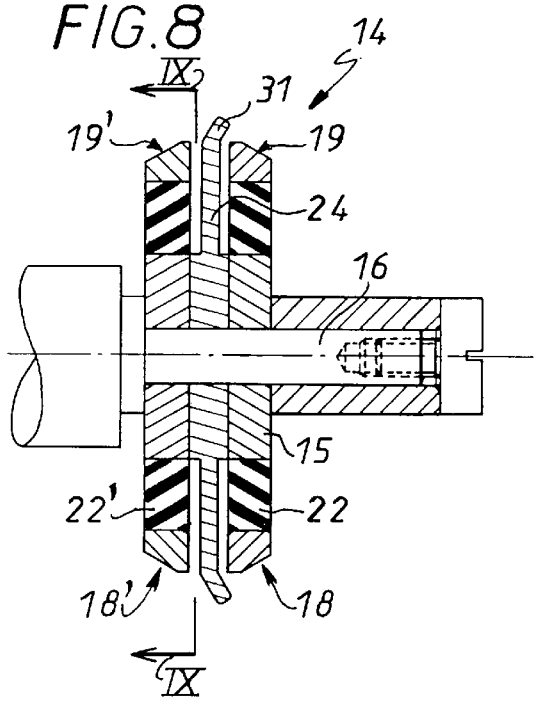
FIG. 8 is another view in axial section similar to that of FIG. 1, relating to a third variant of the beveling tool according to the invention.

In the embodiments shown more particularly in FIGS. 1 to 5 and in FIGS. 8 and 9, they are even identical.

In particular, they have active peripheries 19, 19' whose mean radii R, R' are equal and each of them is associated with an intermediate part 22, 22'.

In service, that is to say when the beveling tool 14, e.g. its working rim 18, or to be more precise the active periphery 19 of its working rim 18, is applied to the spectacle lens 10 to be worked, the working rim 18 tilts by a greater or lesser amount relative to the axis of the hub 15, depending on the corresponding applied force, by virtue of elastic deformation of the compensation means used for this purpose, as shown in FIG. 3.

At the corresponding point of contact, this retracts the working rim 18 in a more or less accentuated way relative to the spectacle lens 10.

Figure 4:
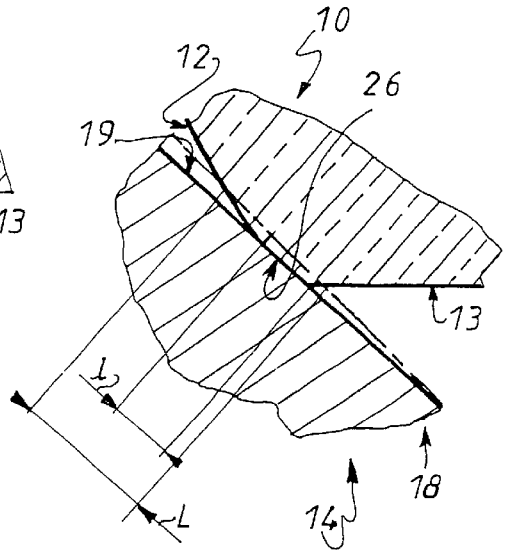
FIG. 4 shows to a larger scale the detail IV from FIG. 3.

Accordingly, and as shown diagrammatically in FIG. 4, in which the original position of the working rim 18 is shown diagrammatically in dashed outline and its retracted position is shown in continuous outline, the value I across the flat (i.e. the width) of the bevel 26 formed is less than the value across the flat L that would have been obtained in the absence of any such retraction.

The overall result is to regularize the value across the flat.

Of course, the working rim 18 retracts relative to the spectacle lens 10 being worked only within limits allowed by the abutment means 23, i.e. by the disk 24, with which the working rim 18 comes into abutting contact in due course.

Note that the ability of the rim to retract is beneficial to the durability of the beveling function, in that it allows some wear.

Figure 5:
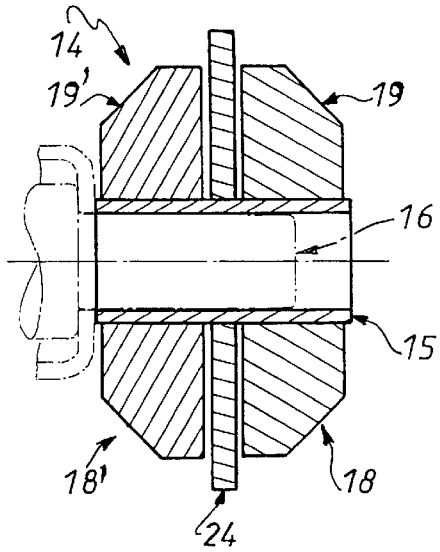
FIG. 5 is a view in axial section similar to that of FIG. 1, relating to a first variant of the beveling tool according to the invention.

In the embodiment shown in FIG. 5, the working rim 18 is at least partly made from a flexible material and thereby of itself constitutes compensation means having a capacity for elastic deformation. The same applies to the working rim 18', for example.

To be more precise, in the embodiment shown in FIG. 5, the working rim 18 and the working rim 18' include a flexible material binder, for example an elastomer binder, in which are disseminated, at least at the surface, abrasive grains of an appropriate material, such as one of the materials mentioned above.

Otherwise, everything is as before, in particular with regard to the elasticity characteristics and the cutting power.

Note that these two parameters must be chosen conjointly.

Thus if the cutting power is low, the elasticity must be high to apply a sufficient tool/glass bearing force to compensate the low cutting power.

Conversely, if the cutting power is high, the elasticity must be low to apply a low tool/glass bearing force.

Figure 7:
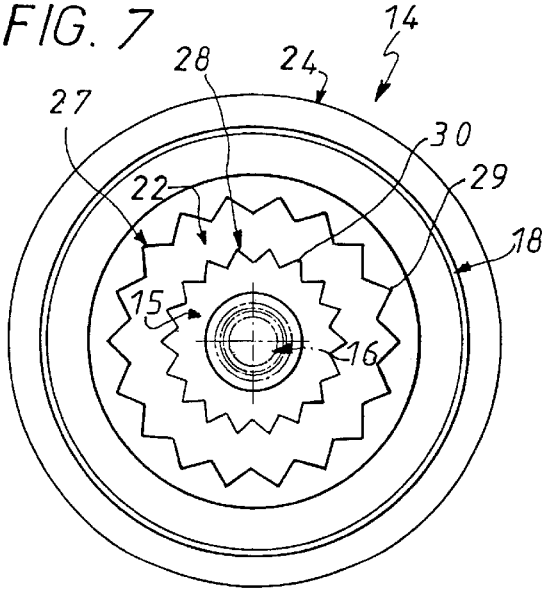
FIG. 7 is a view of the second variant in elevation as seen in the direction of the arrow VII in FIG. 6.
Figure 6:
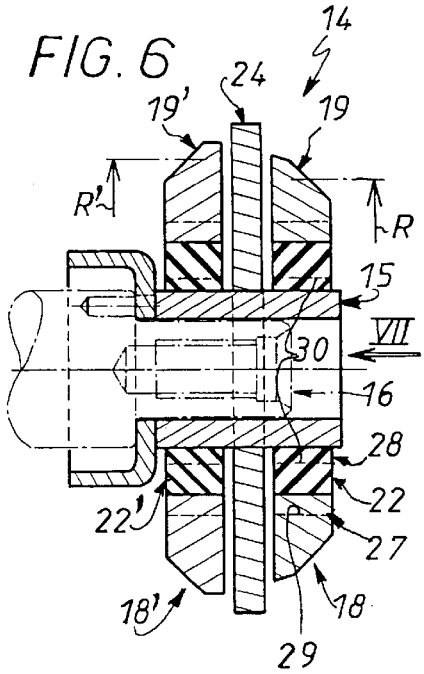
FIG. 6 is another view in axial section similar to that of FIG. 1, relating to a second variant of the beveling tool.

In the embodiment shown in FIGS. 6 and 7, which is of the same type as that shown in FIGS. 1 to 4 with an intermediate part 22, 22', the two working rims 18, 18' have active peripheries 19, 19' whose mean radii R, R' are different.

It is therefore possible, depending on the spectacle lenses 10 to be worked, and/or depending on whether it is its front edge 11 or its rear edge that is to be ground, to grind this kind of spectacle lens 10 using one or the other of the two working rims 18, 18', and thus with different radii, enabling different forces to be applied to it.

For example, machining the spectacle lens 10 with a small radius of the beveling tool 14 enables the stiffness of the compensation means to be increased and, conversely, machining with a large radius enables the stiffness to be reduced.

In either case, it is possible to operate in this way on the force transmitted and therefore on the resulting pressure.

To be more precise, in the case of simple deburring, for example, the working rim 18' having the larger mean radius R' is preferably used.

On the other hand, if a relatively large bevel is required, the working rim 18 having the smaller mean radius R is preferably used.

Moreover, in the embodiment shown in FIGS. 6 and 7, mechanical anchoring means 27 are preferably operative, as shown here, between the working rim 18, 18' and the intermediate part 22, 22' forming the corresponding compensation means. The mechanical anchorage means reinforce the rotational fastening between the working rim 18, 18' and the intermediate part 22, 22'

Similarly, and for the same reasons, mechanical anchorage means 28 are operative between the intermediate part 22, 22' and the hub 15.

For example, the mechanical anchorage means 27, 28 consist of respective teeth 29, 30 which extend annularly and in a regular and complementary manner between the parts in question.

In the embodiment shown in FIGS. 8 and 9, there is no hub 15 common to the working rims 18 and 18' and the disk 24, but instead three individual hubs 15.

What is more, between the rim 18 and its hub 15, and even between the rim 18' and its hub 15, the intermediate part 22, 22' does not consist of a continuous one-piece member but instead of a plurality of separate members, which in this case take the form of spokes. The elasticity characteristics of these members are chosen so that they are equivalent to those of a continuous one-piece member (see above).

Finally, the periphery of the disk 24, beyond the working rims 18 and 18', includes a flange 31 for grinding a groove in the peripheral contour 13 of the spectacle lens 10.

Figure 10:
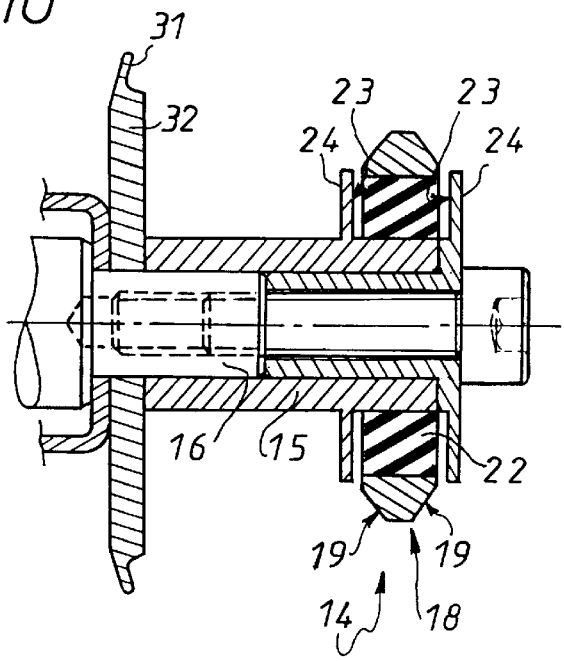
FIG. 10 is another view in axial section similar to that of FIG. 1, relating to a fourth variant of the beveling tool according to the invention.

In the embodiment shown in FIG. 10, the tool 14 has only one working rim 18, but the active periphery 19 of that working rim has a frustoconical facet on each side, so that the same working rim 18 can make the bevel between the front face 12 and the peripheral contour 13 of the spectacle lens 10 and the bevel between the peripheral contour 13 and the rear face.

The abutment means 23 of the tool 14 shown in FIG. 10 do not consist of a single disk 24, but instead of two disks 24, one on each side of the working rim 18; one of the disks 24 is used to grind the bevel on the same side as the front face of the spectacle lens 10 and the other disk is used to grind the bevel on the same side as the rear face.

Note that providing two disks 24, one on each side of the rim 18, guarantees that the rim is held in position in the event of accidental separation of the intermediate part 22 and the working rim 18 or the intermediate part 22 and the hub 15.

To facilitate assembly, the disk 24 shown on the left in FIG. 10 is fastened to the hub 15 and the disk 24 shown on the right is fastened to a counter-hub which has an annular part which bears on the end of the hub 15 and a tubular part accommodated inside the hub 15 and bearing on the end of the support shaft 16.

In this embodiment, the flange 31 for grinding the peripheral groove 13 in the spectacle lens 10 is not on a disk 24 that is part of the abutment means 23 but instead at the periphery of a disk 32 mounted on the support shaft 16, like the tool 14.

Note that small diameter spectacle lenses can be beveled because the diameter of the disk 24 in this embodiment is less than the smallest diameter of the abrasive periphery 19.

In embodiments that are not shown, the respective connections provided by the mechanical anchorage means 27 and 28 in the embodiment shown in FIGS. 6 and 7 are replaced by a connection of the same type as in the other embodiments shown, i.e. by adhesive bonding, and, conversely, the adhesive bonding connections of the other embodiments shown are replaced by connections using mechanical anchorage means of the same kind as the means 27 and 28 shown in FIGS. 6 and 7.

In other variants that are not shown of the embodiments just described with reference to FIGS. 1 to 7 and 10, the continuous one-piece intermediate member is replaced by a part consisting of several separate members, in the form of spokes, as in FIGS. 8 and 9, or in some other appropriate form, and the intermediate part consisting of several separate members shown in FIGS. 8 and 9 is replaced by a continuous one-piece intermediate member.

In further variants that are not shown of the embodiments shown in FIGS. 1 to 7, the disk 24 has at its periphery a grooving tool of the same kind as the flange 31 shown in FIGS. 8 to 10.

In further embodiments that are not shown, the beveling tool 14 has two separate rims, for example one with a continuous one-piece intermediate part and the other with an intermediate part in the form of several members, in order to adapt optimally to the work to be carried out.

Of course, the present invention is not limited to the embodiments described and shown, but encompasses any variant execution and/or combination of their various component parts.

In particular, the hub of the beveling tool could be formed directly by the inside periphery of its working rim or that of the intermediate part, if used, without otherwise being more individualized.

Furthermore, instead of being operative within the beveling tool, the compensation means used in accordance with the invention could equally well be operative in the mounting of the spectacle lens on its support shaft.

There is claimed:

1. A tool for beveling spectacle lenses, the tool comprising:

a hub structured and arranged to be fitted to a support shaft, at least one working rim rotatable with said hub, and compensation means having a capacity for elastic deformation between an active periphery of said working rim and said hub, said active periphery extending along a single frustoconical facet of said rim.

2. The beveling tool claimed in claim 1, wherein said working rim is made of a rigid material and said compensation means include an intermediate part made of a flexible material disposed between said working rim and said hub.

3. The beveling tool claimed in claim 2, further comprising a mechanical anchor between said working rim and said intermediate part.

4. The beveling tool claimed in claim 2, further comprising a mechanical anchor between said intermediate part and said hub.

5. The beveling tool claimed in claim 3, wherein said mechanical anchor consists of teeth.

6. The beveling tool claimed in claim 1, wherein said working rim is made at least partly from a flexible material and thereby of itself constitutes compensation means.

7. The beveling tool claimed in claim 6, wherein said working rim includes a flexible material binder in which abrasive means are disseminated, at least at its surface.

8. The beveling tool claimed in claim 1, wherein said compensation means have an elasticity corresponding to a yield stress from 4 MPa to 10 MPa and an elongation at the yield point greater than 200%.

9. The beveling tool claimed in claim 1, wherein said compensation means have an elasticity corresponding to a Shore A hardness from 40 to 80 and/or a tearing limit greater than 4 $DaN/cm^2$.

10. The beveling tool claimed in claim 1, wherein said working rim is associated with abutment means from which it is separated by a clearance when at rest.

11. The beveling tool claimed in claim 10, wherein said abutment means associated with said working rim include a disk coaxial with, fastened to and transverse to said hub.

12. The beveling tool claimed in claim 11, wherein a face of said working rim facing toward said disk is parallel to said disk.

13. The beveling tool claimed in claim 11, including two working rims, one on each side of said disk, and wherein said hub is common to both said rims.

14. The beveling tool claimed in claim 13, wherein said two working rims have active peripheries whose mean radii are different.

15. The beveling tool claimed in claim 2, wherein said intermediate part is in one piece and continuous.

16. The beveling tool claimed in claim 2, wherein said intermediate part is formed of several separate members.

17. The beveling tool claimed in claim 16, wherein said separate members are in the form of spokes.

18. The beveling tool claimed in claim 1, including a working rim whose active periphery has two opposed frustoconical facets.

19. The beveling tool claimed in claim 11, including two disks, one on each side of said working rim.

20. A tool for beveling spectacle lenses, the tool comprising:

a hub structured and arranged to be fitted to a support shaft;

at least one working rim rotatable with said hub; and a compensation element having a capacity for elastic deformation between an active periphery of the working rim and the hub, wherein said working rim is associated with abutment means from which the rim is separated by a clearance when at rest.

* * * * *